US010186350B2

(12) United States Patent
Kusuma et al.

(10) Patent No.: US 10,186,350 B2
(45) Date of Patent: Jan. 22, 2019

(54) CABLE HAVING SHIELDING TAPE WITH CONDUCTIVE SHIELDING SEGMENTS

(71) Applicant: General Cable Technologies Corporation, Highland Heights, KY (US)

(72) Inventors: Roy B. Kusuma, Cincinnati, OH (US); Stephen A. Thwaites, Walton, KY (US); Scott M. Brown, Independence, KY (US); James D. Malkemus, Union, KY (US); David M. Fausz, Newport, KY (US)

(73) Assignee: General Cable Technologies Corporation, Highland Heights, KY (US)

( * ) Notice: Subject to any disclaimer, the term of this patent is extended or adjusted under 35 U.S.C. 154(b) by 13 days.

(21) Appl. No.: 15/659,900

(22) Filed: Jul. 26, 2017

(65) Prior Publication Data

US 2018/0033523 A1 Feb. 1, 2018

Related U.S. Application Data

(60) Provisional application No. 62/366,701, filed on Jul. 26, 2016.

(51) Int. Cl.
*H01B 7/02* (2006.01)
*H01B 11/08* (2006.01)
(Continued)

(52) U.S. Cl.
CPC ..... *H01B 11/085* (2013.01); *H01B 7/0216* (2013.01); *H01B 11/1008* (2013.01); *H01B 13/2673* (2013.01)

(58) Field of Classification Search
CPC ..... H01B 11/085; H01B 7/0216
See application file for complete search history.

(56) References Cited

U.S. PATENT DOCUMENTS 1,132,452 A 3/1915 Davis
3,090,825 A 5/1963 Volk
(Continued)

FOREIGN PATENT DOCUMENTS

AU 1524097 A 8/1997
BR 9706962 A 10/2000
(Continued)

OTHER PUBLICATIONS

Copenheaver, Blaine R.; International Search Report and Written Opinion of the International Searching Authority, issued in International Application No. PCT/US2017/043898; dated Oct. 25, 2017; 10 pages.

*Primary Examiner* — William H. Mayo, III
*Assistant Examiner* — Rhadames Alonzo Miller
(74) *Attorney, Agent, or Firm* — Ulmer & Berne LLP

(57) ABSTRACT

A cable includes a first twisted pair of insulated conductors, a second twisted pair of insulated conductors, a shielding tape, and an outer jacket surrounding the first twisted pair of insulated conductors, the second twisted pair of insulated conductors and the shielding tape. The shielding tape includes a substrate and a plurality of conductive shielding segments. The plurality of conductive shielding segments is disposed on the substrate. Each conductive shielding segment is spaced from each immediately adjacent conductive shielding segment in a longitudinal direction.

17 Claims, 6 Drawing Sheets

(51) Int. Cl.
*H01B 11/10* (2006.01)
*H01B 13/26* (2006.01)

(56) References Cited

U.S. PATENT DOCUMENTS

| | | | | |
|---|---|---|---|---|
| 3,312,774 | A | 4/1967 | Peterson | |
| 3,770,570 | A | 11/1973 | Swearingen et al. | |
| 3,870,977 | A | 3/1975 | Peoples et al. | |
| 4,129,841 | A | 12/1978 | Hildebrand et al. | |
| 4,596,897 | A | 6/1986 | Gruhn | |
| 4,746,767 | A | 5/1988 | Gruhn | |
| 5,008,489 | A | 4/1991 | Weeks, Jr. et al. | |
| 5,473,336 | A | 12/1995 | Harman et al. | |
| 5,767,441 | A | 6/1998 | Brorein et al. | |
| 5,855,988 | A | 1/1999 | Matsuo | |
| 6,248,954 | B1 * | 6/2001 | Clark | H01B 11/04 174/113 R |
| 6,254,924 | B1 | 7/2001 | Brorein et al. | |
| 6,288,340 | B1 * | 9/2001 | Arnould | H01B 11/085 174/113 R |
| 6,597,067 | B1 | 7/2003 | Biery et al. | |
| 6,802,743 | B2 | 10/2004 | Aekins et al. | |
| 6,893,296 | B2 | 5/2005 | Aekins et al. | |
| 7,078,614 | B1 | 7/2006 | Van Haaster | |
| 7,332,676 | B2 | 2/2008 | Sparrowhawk | |
| 7,335,837 | B2 * | 2/2008 | Pfeiler | H01B 11/085 174/113 C |
| 7,530,854 | B2 | 5/2009 | Aekins | |
| 7,532,794 | B2 | 5/2009 | Cook | |
| 7,534,964 | B2 * | 5/2009 | Clark | H01B 11/06 174/113 AS |
| 7,555,350 | B2 | 6/2009 | MacDonald | |
| 7,637,776 | B2 | 12/2009 | McNutt et al. | |
| 7,639,205 | B2 | 12/2009 | Kuduo et al. | |
| 7,790,981 | B2 | 9/2010 | Vaupotic et al. | |
| 7,804,439 | B2 | 9/2010 | Yoshida et al. | |
| 7,834,270 | B2 | 11/2010 | Zhu et al. | |
| 7,834,271 | B2 | 11/2010 | Gromko et al. | |
| RE42,266 | E | 4/2011 | Sparrowhawk | |
| 7,923,641 | B2 | 4/2011 | Smith et al. | |
| 8,119,906 | B1 * | 2/2012 | Smith | H01B 11/1008 174/36 |
| 8,119,907 | B1 | 2/2012 | McNutt | |
| 8,183,462 | B2 | 5/2012 | Nordin et al. | |
| 8,217,267 | B2 | 7/2012 | Nordin | |
| 8,354,590 | B2 | 1/2013 | Nordin et al. | |
| 8,395,045 | B2 | 3/2013 | Smith et al. | |
| 8,445,787 | B2 | 5/2013 | Nordin et al. | |
| 8,558,115 | B2 | 10/2013 | Jenner et al. | |
| 8,629,351 | B2 | 1/2014 | Asplund et al. | |
| 8,927,866 | B2 | 1/2015 | Nordin et al. | |
| 8,946,555 | B2 | 2/2015 | Nordin et al. | |
| 8,987,591 | B2 | 3/2015 | Nordin et al. | |
| 9,044,593 | B2 | 6/2015 | Li et al. | |
| 9,048,007 | B2 | 6/2015 | Hailong et al. | |
| 9,072,192 | B2 | 6/2015 | Lin et al. | |
| 9,087,630 | B2 | 7/2015 | Camp, II et al. | |
| 9,129,727 | B2 | 9/2015 | Caveney et al. | |
| 9,136,043 | B2 | 9/2015 | Brown et al. | |
| 9,196,398 | B2 | 11/2015 | Kroushl et al. | |
| 9,202,610 | B2 | 12/2015 | Gould et al. | |
| 9,251,930 | B1 | 2/2016 | McNutt | |
| 9,275,776 | B1 | 3/2016 | McNut | |
| 9,362,027 | B2 | 6/2016 | Kenny et al. | |
| 9,412,498 | B2 | 8/2016 | Wassmuth et al. | |
| 9,520,210 | B1 * | 12/2016 | Neveux | G02B 6/4495 |
| 2004/0026113 | A1 * | 2/2004 | Bahlmann | H01B 11/06 174/113 C |
| 2004/0055781 | A1 * | 3/2004 | Cornibert | H01B 11/06 174/135 |
| 2009/0223694 | A1 * | 9/2009 | Nordin | H01B 11/1008 174/34 |
| 2010/0117660 | A1 * | 5/2010 | Douglas | H03K 17/955 324/658 |
| 2010/0157566 | A1 | 6/2010 | Bogursky et al. | |
| 2012/0067614 | A1 | 3/2012 | Camp, II et al. | |
| 2012/0080209 | A1 | 4/2012 | McLinn et al. | |
| 2012/0080210 | A1 | 4/2012 | Camp, II et al. | |
| 2012/0080211 | A1 | 4/2012 | Brown et al. | |
| 2012/0177906 | A1 | 7/2012 | Sousa et al. | |
| 2013/0008684 | A1 | 1/2013 | Weitzel et al. | |
| 2013/0161063 | A1 | 6/2013 | Gould et al. | |
| 2013/0333936 | A1 * | 12/2013 | Gundel | H01B 7/0838 174/350 |
| 2014/0262411 | A1 * | 9/2014 | Hopkinson | H01B 11/085 174/34 |
| 2016/0037691 | A1 | 2/2016 | Kroushl et al. | |

FOREIGN PATENT DOCUMENTS

| | | | |
|---|---|---|---|
| CA | 2603101 | A1 | 10/2006 |
| CN | 100553037 | C | 10/2009 |
| DE | 69730009 | T2 | 7/2005 |
| EP | 0016958 | B1 | 6/1982 |
| EP | 1089605 | A2 | 4/2001 |
| EP | 0871964 | B1 | 7/2004 |
| EP | 1872440 | B1 | 1/2008 |
| EP | 2592631 | A1 | 5/2013 |
| FR | 3029387 | A3 | 6/2016 |
| GB | 1037944 | | 8/1966 |
| GB | 2432963 | A | 6/2007 |
| ID | 17205 | A | 12/1997 |
| ID | 27079 | A | 12/1997 |
| JP | S63-171912 | A | 7/1988 |
| JP | H5-277661 | A | 10/1993 |
| JP | H9-185913 | A | 7/1997 |
| JP | 2009205828 | A | 9/2009 |
| JP | 2013-225516 | A | 10/2013 |
| JP | 2014-44956 | A | 3/2014 |
| JP | 2014-150066 | A | 8/2014 |
| JP | 2014-150067 | A | 8/2014 |
| JP | 2014-239054 | A | 12/2014 |
| JP | 2015-43328 | A | 3/2015 |
| KR | 101127252 | B1 | 3/2012 |
| WO | 9725725 | A2 | 7/1997 |
| WO | 2004071144 | A1 | 8/2004 |
| WO | 2006105166 | A2 | 10/2006 |
| WO | 2010003215 | A1 | 1/2010 |
| WO | 2014077492 | A1 | 5/2014 |
| WO | 2015026029 | A1 | 2/2015 |
| ZA | 9700022 | B | 10/1997 |

* cited by examiner

CABLE HAVING SHIELDING TAPE WITH CONDUCTIVE SHIELDING SEGMENTS

REFERENCE TO RELATED APPLICATION

This application claims priority of U.S. provisional patent application Ser. No. 62/366,701, entitled Cable Having Shielding Tape with Conductive Shielding Segments, filed Jul. 26, 2016, and hereby incorporates this provisional patent application by reference herein in its entirety.

TECHNICAL FIELD

The articles and methods described below generally relate to cables having a shielding tape. The shielding tape includes discontinuous shielding segments.

BACKGROUND

Conventional data cables typically include twisted pairs of insulated conductors that are surrounded by a shield and/or are separated by a separator to alleviate signal interference among adjacent parallel conductors (crosstalk). These conventional arrangements can be bulky and expensive to manufacture.

SUMMARY

In accordance with one embodiment, a cable comprises a first twisted pair of insulated conductors, a second twisted pair of insulated conductors, a third twisted pair of insulated conductors, a fourth twisted pair of insulated conductors, a first shielding tape, a second shielding tape, and an outer jacket. The first shielding tape extends between the first and second twisted pairs of conductors and between the second and third twisted pairs of conductors. The first shielding tape comprises a first substrate and a plurality of first conductive shielding segments. The plurality of first conductive shielding segments is disposed on the first substrate. Each first conductive shielding segment is spaced from each immediately adjacent first conductive shielding segment in a longitudinal direction. The second shielding tape extends between the third and fourth twisted pairs of conductors and between the first and fourth twisted pairs of conductors. The second shielding tape comprises a second substrate and a plurality of second conductive shielding segments. The plurality of second conductive shielding segments is disposed on the second substrate. Each second conductive shielding segment is spaced from each immediately adjacent second conductive shielding segment in a longitudinal direction. The outer jacket surrounds the first, second, third, and fourth twisted pairs of insulated conductors and the first and second shielding tapes.

In accordance with another embodiment, a cable comprises a first twisted pair of insulated conductors, a second twisted pair of insulated conductors, a substantially flat separator, and an outer jacket that surrounds the first twisted pair of insulated conductors, the second twisted pair of insulated conductors, and the substantially flat separator. The substantially flat separator extends between the first and second twisted pairs of insulated conductors. The substantially flat separator comprises a plurality of first conductive shielding segments and a first substrate. Each first conductive shielding segment is spaced from each immediately adjacent first conductive shielding segment in a longitudinal direction. The first substrate overlies the plurality of first conductive shielding segments. The first substrate is formed of a dielectric material.

BRIEF DESCRIPTION OF THE DRAWINGS

It is believed that certain embodiments will be better understood from the following description taken in conjunction with the accompanying drawings in which.

DETAILED DESCRIPTION

Figure 1:
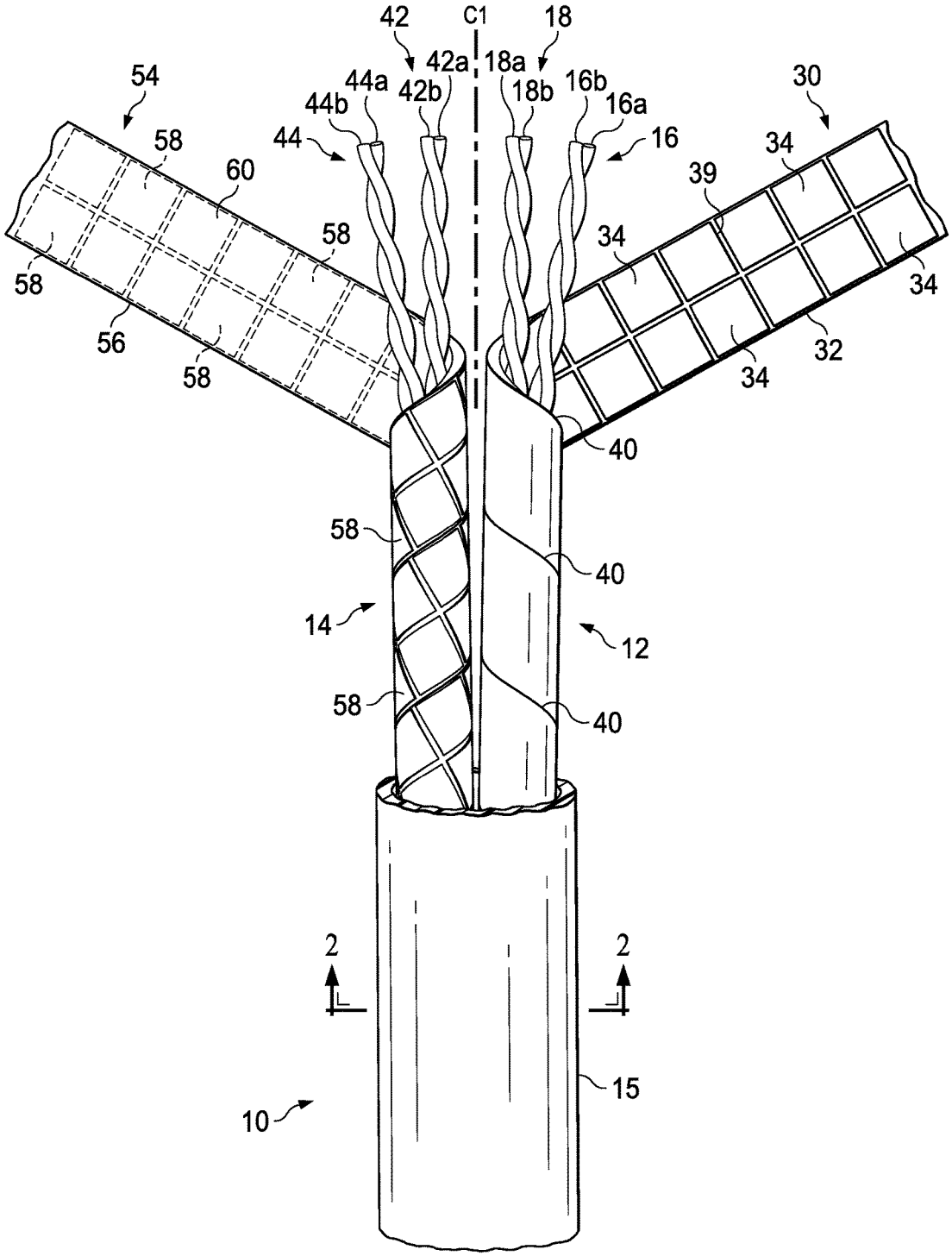
FIG. 1 is a perspective view depicting a cable at least partially unwound for clarity of illustration, in accordance with one embodiment.
Figure 2:
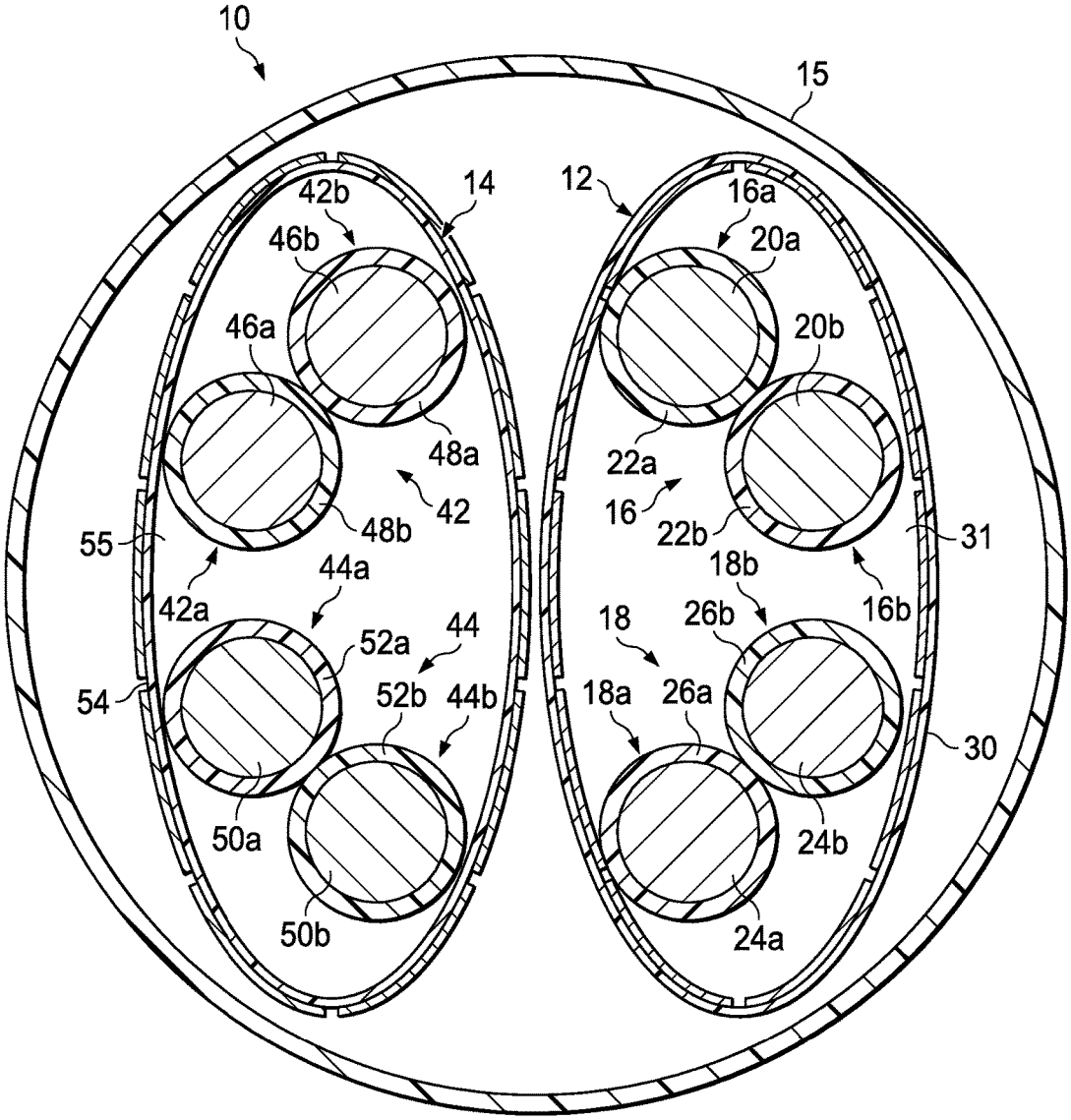
FIG. 2 is a cross-sectional view taken along the line 2-2 in FIG. 1.

In connection with the views and examples of FIGS. 1-12, wherein like numbers indicate the same or corresponding elements throughout the views, FIGS. 1 and 2 illustrate a cable 10 comprising a first core 12, a second core 14, and an outer jacket 15 surrounding the first and second cores 12, 14. The outer jacket 15 can be formed of an electrically insulating material, such as polyvinylchloride, for example. The first core 12 can include first insulated conductors 16*a*, 16*b* and second insulated conductors 18*a*, 18*b* that are twisted into respective first and second pairs 16, 18 (e.g., twisted pairs). As illustrated in FIG. 2, each of the first insulated conductors 16*a*, 16*b* can include respective conductive elements 20*a*, 20*b* that are coated with respective insulating layers 22*a*, 22*b*. Each of the second insulated conductors 18*a*, 18*b* can include respective conductive elements 24*a*, 24*b* that are coated with respective insulating layers 26*a*, 26*b*. The conductive elements 20*a*, 20*b*, 24*a*, 24*b* can be formed of copper, aluminum, or any of a variety of other suitable conductive materials. In one embodiment, the insulating layers 22*a*, 22*b*, 26*a*, 26*b* can be formed of a foamed material. The foamed material can provide enhanced insulating characteristics relative to a solid material due to the air voids imparted to the foamed material during manufacture. Foaming the insulating layers 22*a*, 22*b*, 26*a*, 26*b* can also allow the first core 12 to be provided without a separate barrier layer. It is to be appreciated that the insulating layers 22*a*, 22*b*, 26*a*, 26*b* can be formed of any of a variety of insulating materials and in some cases might not be foamed.

Figure 3:
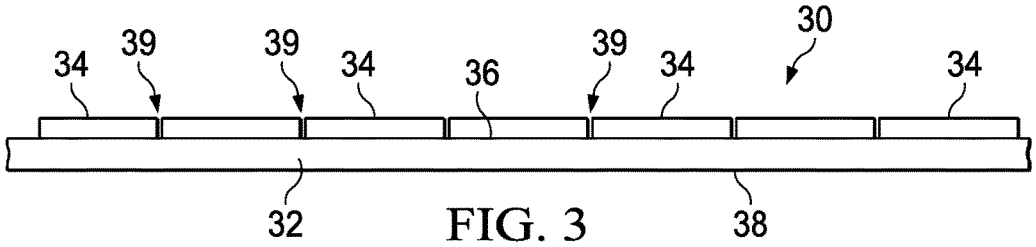
FIG. 3 is a side view depicting a first shielding tape of the cable of FIG. 1, in accordance with one embodiment.

The first core 12 can also include a first shielding tape 30 that surrounds the first and second twisted pairs 16, 18 such that the first shielding tape 30 defines a first passage 31 (FIG. 2) through which the first and second twisted pairs 16, 18 are routed. As illustrated in FIGS. 1 and 3, the first shielding tape 30 can comprise a first substrate 32 and a plurality of conductive shielding segments 34 disposed on the first substrate 32. The first substrate 32 can be formed of one or more non-conductive materials, and the plurality of conductive shielding segments 34 can be formed of a conductive material. In one embodiment, the first substrate 32 can be formed of one or more layers of biaxially-oriented polyethylene terephthalate (PET) and the plurality of conductive shielding segments 34 can be formed of an aluminum alloy (e.g., an aluminum/PET tape). In some embodiments, the PET tape can be MYLAR.

It is to be appreciated that the first substrate 32 can be formed of any of a variety of suitable additional or alternative insulating materials, such as, for example, an olefin (e.g., a polypropylene or polyvinylchloride), and/or a fluoropolymer, such as FEP, ECTFE, MFA, PFA and PTFE. The first substrate 32 can, additionally or alternatively, include fibrous filler strands, such as, for example, woven or non-woven strands of fiberglass. These fibrous filler strands can be included in the first substrate 32 to enhance the flame and smoke properties of the first shielding tape 30. It is to be appreciated that the first substrate 32 can be formed of a single layer of material or a plurality of the same or different materials.

Although the conductive shielding segments 34 are described as being formed of aluminum, it is to be appreciated that the conductive shielding segments 34 can be formed of any of a variety of suitable additional or alternative conductive materials, such as, for example, pure aluminum or copper. In one embodiment, the conductive shielding segments 34 can have a thickness between about 0.0003 inches and about 0.0030 inches. Each of the conductive shielding segments 34 can be spaced from each immediately adjacent conductive shielding segment 34 in a longitudinal direction (i.e., parallel to a longitudinal centerline C1 of the cable 10) such that the conductive shielding segments 34 are separated by gaps 39 to form a discontinuous shield. In one embodiment, as illustrated in FIGS. 1 and 3, the conductive shielding segments 34 can have a substantially rectangular shape such that each conductive shielding segment 34 is spaced from each immediately adjacent conductive shielding segment 34 in each of a longitudinal direction and a radial direction (i.e., parallel and perpendicular to the longitudinal centerline C1 of the cable 10). In one embodiment, the conductive shielding segments 34 can be sized to overlie at least about 90% of the first substrate 32. In some embodiments, the conductive shielding segments 34 can be formed by laser cutting the gaps 39 into a continuous sheet of conductive material (e.g., aluminum). In such an embodiment, the gaps 39 can be between about 10 microns and about 100 microns thick.

It is to be appreciated that the overall configuration of the conductive shielding segments 34 (e.g., the shape, length, and/or width) can be selected to achieve effective shielding properties for the cable 10 and to alleviate alien crosstalk among the twisted pairs 16, 18 in the absence of a dedicated ground wire. The conductive shielding segments 34 can be configured to be any of a variety of shapes, such as, for example, square, rectangular, parallelogram, trapezoidal, chevron, diamond, or any combination thereof. In some embodiments, the longitudinal distance and/or the radial distance between the conductive shielding segments 34 can be consistent among the conductive shielding segments 34. In other embodiments, one or more of the length, the width, and the shape of the conductive shielding segments 34 can be random which can alleviate resonance between the conductive shielding segments 34 as well as adverse interactions between the twisted pairs 16, 18. Although the conductive shielding segments 34 are described as being electrically discontinuous, in some alternative embodiments, a continuous shield can be provided along the length of the cable.

In one embodiment, the conductive shielding segments 34 can be adhered to the first substrate 32 with an adhesive. In another embodiment, the conductive shielding segments 34 can be applied to the first substrate 32 via an application process such as, for example, heat pressing, laser ablation, vapor deposition, or by spraying conductive particles onto the first substrate 32. In yet another embodiment, the conductive shielding segments 34 can be conductive particles which are embedded in the first substrate 32. These conductive particles can be formed of aluminum, iron oxides, nickel, zinc, silver, carbon nano-fibers, or any of a variety of suitable alternative conductive particulates.

Referring now to FIG. 3, in one embodiment, the first substrate 32 is shown to include a first surface 36 and a second surface 38 that is opposite from the first surface 36 (e.g., opposing surfaces). In such an embodiment, the conductive shielding segments 34 can be disposed only on the first surface 36, such that the second surface 38 is devoid of conductive shielding segments. In another embodiment, the conductive shielding segments 34 can be disposed on each of the first surface 36 and the second surface 38.

Referring again to FIG. 1, the first shielding tape 30 can be helically wound around the first and second twisted pairs 16, 18 with the conductive shielding segments 34 facing inwardly towards the first and second twisted pairs 16, 18. A portion of the first shielding tape 30 can therefore overlap itself such that some portions of the conductive shielding segments 34 are in contact with the first and second twisted pairs 16, 18 and other portions of the conductive shielding segments 34 are sandwiched between overlapped portions of the first shielding tape 30. With the first shielding tape 30 helically wound around the first and second twisted pairs 16, 18, the first substrate 32 can overlie each of the conductive shielding segments 34 relative to the first passage 31 such that a substantial portion of the second surface 38 of the first substrate 32 that is devoid of conductive shielding segments 34 defines an exterior surface of the first shielding tape 30. In one embodiment, the first shielding tape 30 can be helically wound such that an exposed edge 40 of first shielding tape 30 can lie at a wrap angle of about 15 degrees relative to the centerline C1 with about a 25% overlap with adjacent portions of the first shielding tape 30. It is to be appreciated that, although the first shielding tape 30 is described as being helically wound around the first and second twisted pairs 16, 18, the first shielding tape 30 can surround the first and second twisted pairs 16, 18 in any of a variety of suitable alternative arrangements. For example, the first shielding tape 30 can surround the first and second twisted pairs 16, 18 in a cuffed arrangement such that the exposed edge 40 is substantially parallel with the longitudinal centerline C1 of the cable 10.

The conductive shielding segments 34 of the first shielding tape 30 can be electrically discontinuous along the longitudinal centerline C1 of the cable 10 which can provide more effective shielding of the first and second twisted pairs 16, 18 than certain conventional grounded arrangements. For example, the conductive shielding segments 34 can reduce capacitive coupling between the first and second twisted pairs 16, 18 which can enhance the electromagnetic compatibility (EMC) performance and can provide more consistent high frequency impedance. Additionally, the physical characteristics of each conductive shielding segment 34 (e.g., the shape, the length, and/or the width) as well as the relationship between the conductive shielding segments 34 (e.g., the gaps therebetween) can be selected to enhance the capacitive coupling between the conductive shielding segments 34 thereby enhancing the overall magnitude of the longitudinal impedance of the cable 10. As a result, the first shielding tape 30 can provide reduced signal attenuation at high frequencies along the twisted pairs 16, 18 which can reduce (e.g., flatten) the insertion loss curve as compared to a conventional unshielded arrangement. In addition, the first shielding tape 30 can enhance the shielding between the twisted pairs 16, 18, thereby improving near end crosstalk (NEXT), alien crosstalk (ANEXT), and high frequency attenuation-to-crosstalk ratio (ACR).

Still referring to FIGS. 1-2, the second core 14 can be similar to, or the same as, in many respects as the first core 12. For example, the second core 14 can include third insulated conductors 42*a*, 42*b* and fourth insulated conductors 44*a*, 44*b* that are twisted into respective third and fourth pairs 42, 44 (e.g., twisted pairs). As illustrated in FIG. 2, each of the third insulated conductors 42*a*, 42*b* can include respective conductive elements 46*a*, 46*b* that are coated with respective insulating layers 48*a*, 48*b*. Each of the fourth insulated conductors 44*a*, 44*b* can include respective conductive elements 50*a*, 50*b* that are coated with respective insulating layers 52*a*, 52*b*.

The second core 14 can also include a second shielding tape 54 that surrounds the third and fourth twisted pairs 42, 44 such that the second shielding tape 54 defines a second passage 55 (FIG. 2) through which the third and fourth twisted pairs 42, 44 are routed. The second shielding tape 54 can be the same as, or similar to, the first shielding tape 30. For example, as shown in FIG. 1, the second shielding tape 54 can comprise a second substrate 56 and a plurality of conductive shielding segments 58 disposed on the second substrate 56.

However, the second shielding tape 54 can be helically wound around the third and fourth twisted pairs 42, 44 with the conductive shielding segments 58 facing outwardly such that they are not in contact with the third and fourth twisted pairs 42, 44. A portion of the second shielding tape 54 can overlap itself such that portions of some of the conductive shielding segments 58 are sandwiched between overlapped portions of the second shielding tape 54. With the second shielding tape 54 helically wound around the third and fourth twisted pairs 42, 44 in this manner, the second substrate 56 can underlie each of the conductive shielding segments 58 relative to the second passage 55 such that the conductive shielding segments 58 at least partially define an exterior surface of the second shielding tape 54, and a substantial portion of a surface 60 of the second substrate 56 that is devoid of any conductive shielding segments 58 contacts the third and fourth twisted pairs 42, 44.

It is to be appreciated that by isolating the first and second twisted pairs 16, 18 from the third and fourth twisted pairs 42, 44 with the first and second shielding tapes 30, 54, respectively, crosstalk between the first and second twisted pairs 16, 18 and the third and fourth twisted pairs 42, 44 is suppressed such that the use of certain conventional supplement shielding arrangements, such as a barrier layer and/or separator, can be avoided. This can result in a less complex, less time consuming, and more cost effective cable than conventional arrangements. It is also to be appreciated that since the conductive shielding segments 34, 58 are spaced from each other (i.e., discontinuous) in each of the longitudinal and radial directions, the cable 10 will have less coupling of internal noise factors, as well as better electrical characteristics from the lack of electrical continuity across the cable 10 from phenomena (e.g., "antenna" effects) than conventional cables. These enhancements can allow the cable 10 to maintain sufficient data transmission properties to be rated as a TIA Category 6A (Cat 6) cable. Additionally, with the conductive shielding segments 34, 58 facing inwardly and outwardly, respectively, (e.g., in a "foil in-foil out" arrangement), electrical discontinuity integrity can be maintained between the first and second cores 12, 14 and throughout the length of the cable 10.

Figure 4:
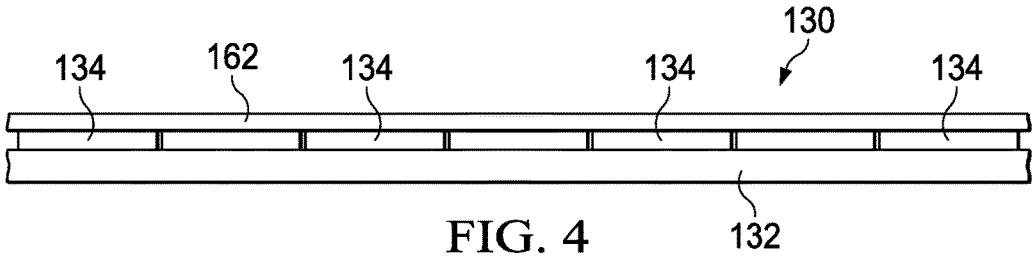
FIG. 4 is a side view depicting a shielding tape, in accordance with another embodiment.

An alternative embodiment of a shielding tape 130 is illustrated in FIG. 4. The shielding tape 130 can be similar to, or the same as, in many respects as the first and second shielding tapes 30, 54 of FIGS. 1-3. For example, the shielding tape 130 can include a substrate 132 and a plurality of conductive shielding segments 134 disposed on the substrate 132. However, the shielding tape 130 can include a protective layer 162 that overlies the conductive shielding segments 134 relative to the substrate 132 such that the conductive shielding segments 134 are sandwiched between the substrate 132 and the protective layer 162. The protective layer 162 can be similar or the same as the first and second substrates 32, 56 of FIGS. 1-3. For example, the protective layer 162 can be formed substantially of biaxially-oriented polyvinylchloride terephthalate. It is to be appreciated that the shielding tape 130 can be used in cable 10 in lieu of the first shielding tape 30 and/or the second shielding tape 54.

Figure 5:
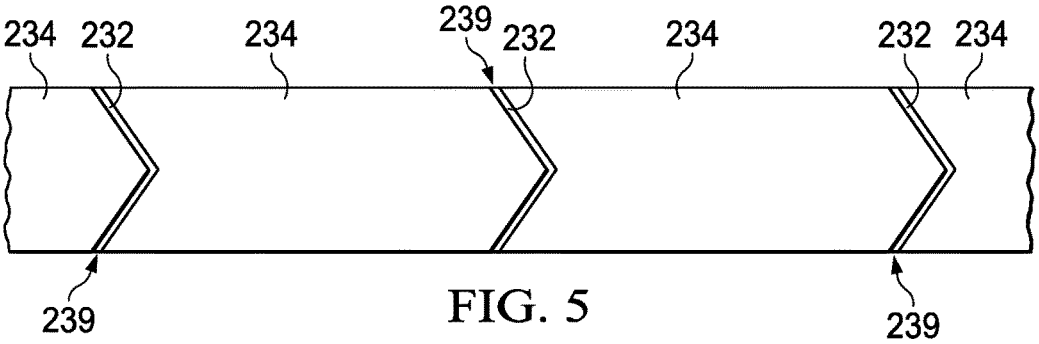
FIG. 5 is a top plan view depicting a shielding tape, in accordance with yet another embodiment.

Another alternative embodiment of a shielding tape 230 is illustrated in FIG. 5. The shielding tape 230 can be similar to, or the same as, in many respects as the first and second shielding tapes 30, 54 of FIGS. 1-3. For example, the shielding tape 230 can include a substrate 232 and a plurality of conductive shielding segments 234 disposed on the substrate 232. However, the conductive shielding segments 234 can be chevron shaped segments that are spaced longitudinally from each other by substantially V-shaped gaps 239. It is to be appreciated that the shielding tape 230 can be used in cable 10 in lieu of the first shielding tape 30 and/or the second shielding tape 54. In one embodiment, the conductive shielding segments 234 can be formed by laser cutting the gaps 239 into a continuous sheet of conductive material (e.g., aluminum) during manufacturing of the cable. In such an embodiment, laser cutters can be provided along an assembly line for the cable and the laser cutters can cut the gaps 239 as the shielding tape 230 is being drawn into place within the cable.

Figure 6:
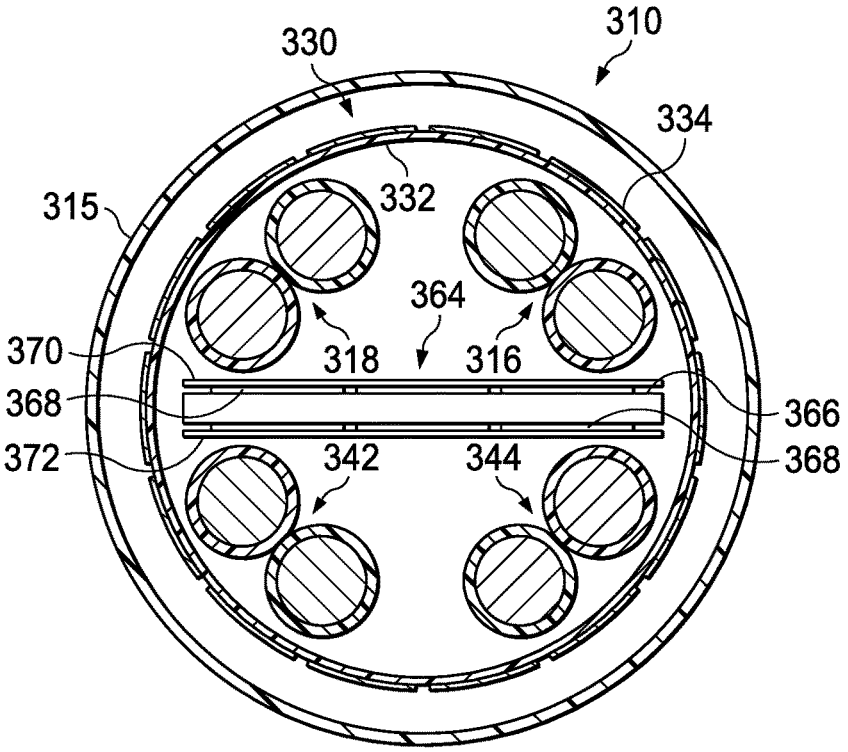
FIG. 6 is a sectional view depicting a cable, in accordance with another embodiment.

An alternative embodiment of a cable 310 is illustrated in FIG. 6. The cable 310 can be similar to, or the same as, in many respects as the cable 10 of FIGS. 1-3. For example, the cable 310 can include first, second, third, and fourth twisted pairs 316, 318, 342, 344 of insulated conductors. An outer shielding tape 330 with conductive shielding segments 334 can surround the first, second, third, and fourth twisted pairs 316, 318, 342, 344. An outer jacket 315 can surround the outer shielding tape 330 such that the conductive shielding segments 334 are sandwiched between a substrate 332 and the outer jacket 315. However, the cable 310 can include a flat separator 364 that is substantially flat and extends between the first and second twisted pairs 316, 318 and the third and fourth twisted pairs 342, 344. The flat separator 364 can include an interior substrate 366 that is formed of any of a variety of suitable dielectric materials such as, for example, polyolefins, such as polypropylene or polyvinylchloride, or fluoropolymers, such as FEP, ECTFE, MFA, and PFA. In one embodiment, the flat separator 364 can be formed of a foamed dielectric material.

The flat separator 364 can include a plurality of conductive shielding segments 368 disposed on the interior substrate 366 that are similar to, or the same as, in many respects as the conductive shielding segments 34 of FIGS. 1-3. An upper substrate 370 can overlie the conductive shielding segments 368 and can be formed of a dielectric material. A lower substrate 372 can underlie the conductive shielding segments 368 and can be formed of a dielectric material. In another embodiment, the shielding tape 330 can be arranged in a reverse orientation on the flat separator 364 such that the conductive shielding segments 368 contact with the flat separator 364 and the side that is devoid of conductive shielding segments 368 is exposed. In yet another embodiment, the conductive shielding segments 368 can be applied to both sides of the substrate 332. In still yet another embodiment, the interior substrate 366 can be formed of conductive shielding segments (e.g., 368) which can be sandwiched between upper and lower substrates (e.g., 370, 372) that are each formed of a dielectric material.

The upper and lower substrates 370, 372 can be applied to the flat separator 364 with adhesive or any of a variety of other suitable alternative application processes. In some embodiments, conductive shielding segments 368 can be applied directly to the flat separator 364, as described in U.S. Pat. Pub. No. 2013/0008684 which is hereby incorporated by reference herein in its entirety.

Figure 7:
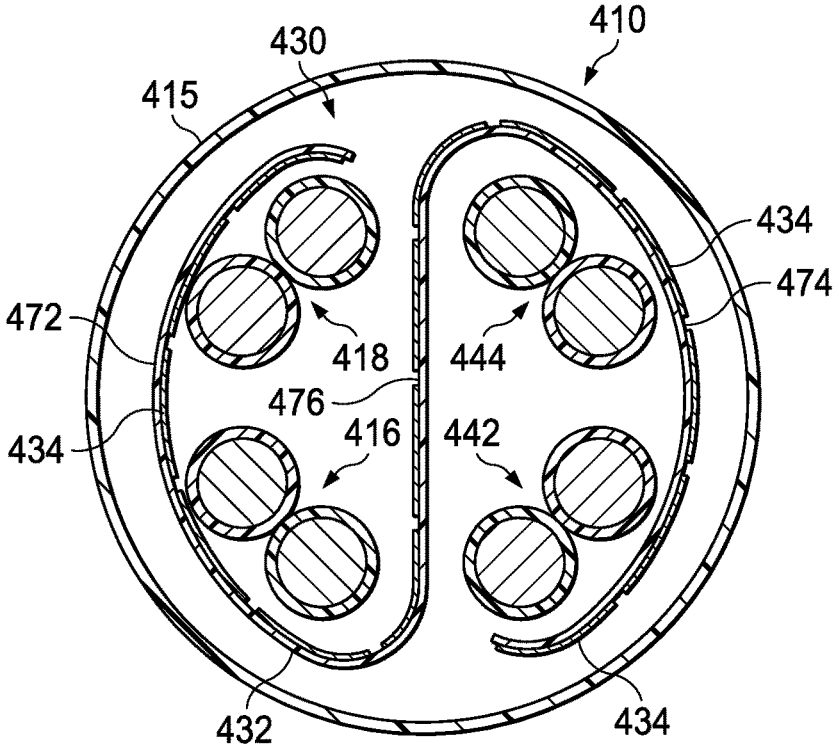
FIG. 7 is a sectional view depicting a cable, in accordance with yet another embodiment.

An alternative embodiment of a cable 410 is illustrated in FIG. 7. The cable 410 can be similar to, or the same as, in many respects as the cable 10 of FIGS. 1-3. For example, the cable 410 can include first, second, third, and fourth twisted pairs 416, 418, 442, 444 of insulated conductors. A shielding tape 430 having a substrate 432 with conductive shielding segments 434 disposed thereon can surround the first, second, third, and fourth twisted pairs 416, 418, 442, 444. An outer jacket 415 can surround the shielding tape 430 and the first, second, third, and fourth twisted pairs 416, 418, 442, 444.

However, the shielding tape 430 can be routed around the first, second, third, and fourth twisted pairs 416, 418, 442, 444 in an S-shape. The shielding tape 430 can have a first end portion 472, a second end portion 474, and a central portion 476 that extends between the first and second end portions 472, 474. The first end portion 472 can be routed between the first and second twisted pairs 416, 418 and the outer jacket 415. The central portion 476 can be routed between the first and second twisted pairs 416, 418 and the third and fourth twisted pairs 442, 444. The second end portion 474 can be routed between the third and fourth twisted pairs 442, 444 and the outer jacket 415.

As illustrated in FIG. 7, in one embodiment, the conductive shielding segments 434 can be applied to only one side of the substrate 432 such that the other side of the substrate 432 is devoid of conductive shielding segments. In another embodiment, conductive shielding segments can be applied to both sides of the substrate 432.

Figure 8:
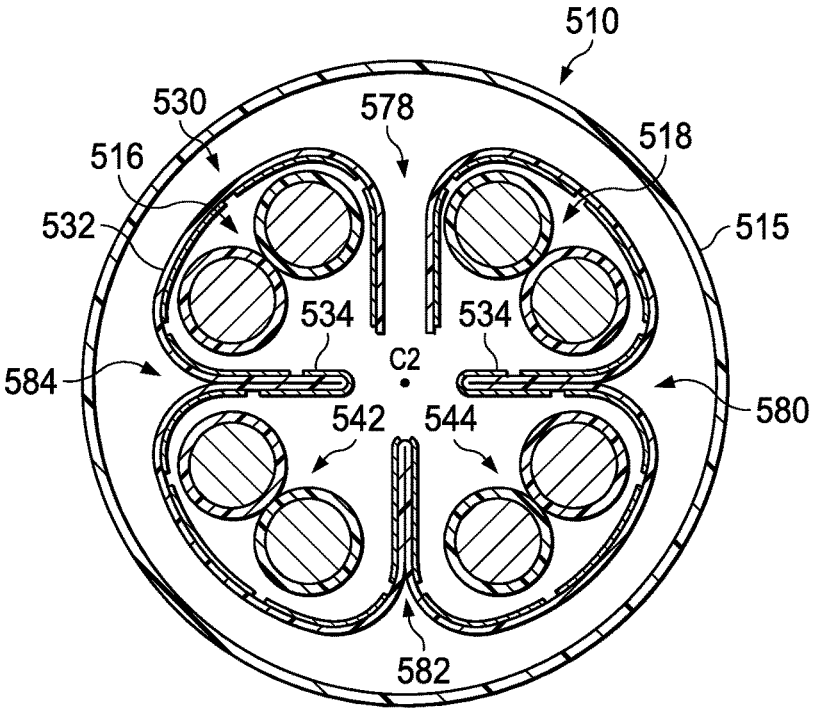
FIG. 8 is a sectional view depicting a cable, in accordance with still yet another embodiment.

Another alternative embodiment of a cable 510 is illustrated in FIG. 8. The cable 510 can be similar to, or the same as, in many respects as the cable 410 of FIG. 7. For example, the cable 510 can include first, second, third, and fourth twisted pairs 516, 518, 542, 544 of insulated conductors. A shielding tape 530 with conductive shielding segments 534 disposed thereon can surround the first, second, third, and fourth twisted pairs 516, 518, 542, 544. An outer jacket 515 can surround the shielding tape 530 and the first, second, third, and fourth twisted pairs 516, 518, 542, 544.

However, the shielding tape 530 can be provided in a cloverleaf shape and can have first, second, third, and fourth overlapping portions 578, 580, 582, 584. For each of the overlapping portions 578, 580, 582, 584, a substrate 532 can be folded together and can extend inwardly towards a centerline C2 of the cable 510. The first overlapping portion 578 can be disposed between the first twisted pair 516 and the second twisted pair 518. The second overlapping portion 580 can be disposed between the second twisted pair 518 and the fourth twisted pair 544. The third overlapping portion 582 can be disposed between the third twisted pair 542 and the fourth twisted pair 544. The fourth overlapping portion 584 can be disposed between the third twisted pair 542 and the first twisted pair 516.

As illustrated in FIG. 8, in one embodiment, the conductive shielding segments 534 can be applied to only one side of the substrate 532 such that the other side of the substrate 532 is devoid of conductive shielding segments. In such an embodiment, the shielding tape 530 can be arranged with the conductive shielding segments 534 facing inwardly (as shown) or outwardly (not shown). When the conductive shielding segments 534 face inwardly, they can be in contact with the first, second, third, and fourth twisted pairs 516, 518, 542, 544. When the conductive shielding segments (e.g., 534) face outwardly, they can be in contact with the outer jacket 515. In another embodiment, the conductive shielding segments (e.g., 534) can be applied to both sides of the substrate 532.

Figure 9:
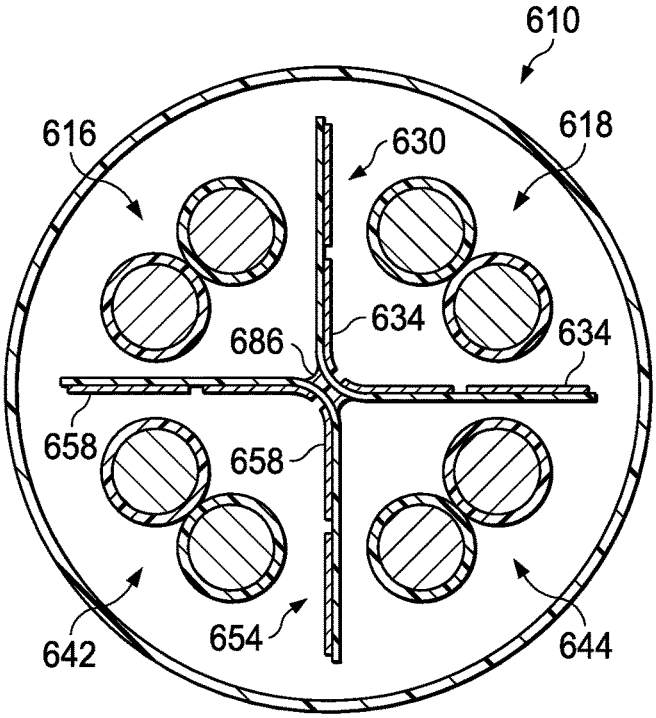
FIG. 9 is a sectional view depicting a cable, in accordance with still yet another embodiment.
Figure 10:
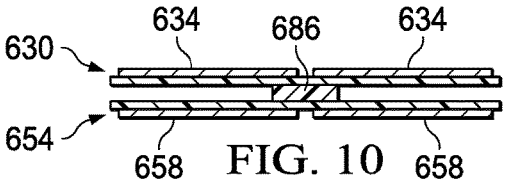
FIG. 10 is a side view depicting a shielding tape of the cable of FIG. 9.

Another alternative embodiment of a cable 610 is illustrated in FIG. 9. The cable 610 can be similar to, or the same as, in many respects as the cable 410 of FIG. 7. For example, the cable 610 can include first, second, third, and fourth twisted pairs 616, 618, 642, 644 of insulated conductors. A first shielding tape 630 and a second shielding tape 654 can include respective pairs of conductive shielding segments 634, 658. However, as illustrated in FIGS. 9 and 10, the first and second shielding tapes 630, 654 can be joined together at a central location 686 such that they cooperate to form an X-shape. The first and second shielding tapes 630, 654 can be routed among the first, second, third, and fourth twisted pairs 616, 618, 642, 644 such that the first shielding tape 630 can extend between the first and second twisted pairs 616, 618 and between the second and fourth twisted pairs 618, 644 and such that the second shielding tape 654 can extend between the first and third twisted pairs 616, 642 and between the third and fourth twisted pairs 642, 644. Although the conductive shielding segments 634 of the first shielding tape 630 are shown to be facing the second twisted pair 618 and the conductive shielding segments 658 of the second shielding tape 654 are shown to be facing the third twisted pair 642, the conductive shielding segments 634, 658 can be provided in any of a variety of alternative arrangements. In some embodiments, an outer shielding tape with conductive shielding segments (not shown) that is similar to or the same as in many respects as the outer shielding tape 330 shown in FIG. 6 can surround the first, second, third, and fourth twisted pairs 616, 618, 642, 644.

Figure 11:
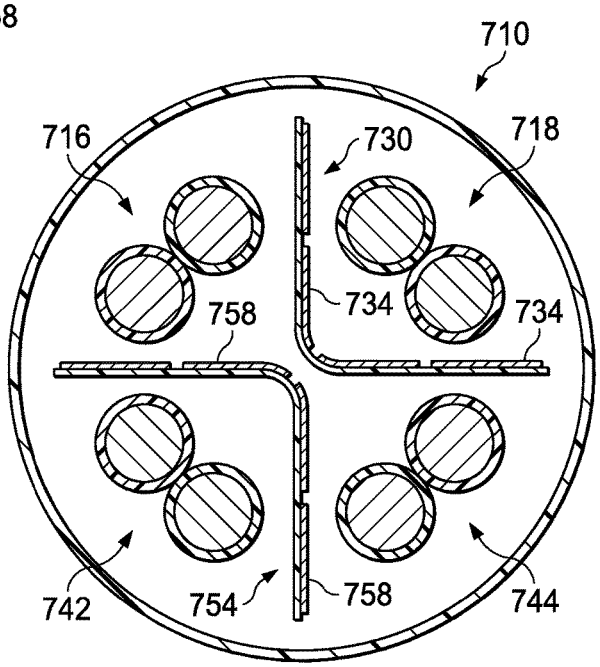
FIG. 11 is a sectional view depicting a cable, in accordance with still yet another embodiment.

Another alternative embodiment of a cable 710 is illustrated in FIG. 11. The cable 710 can be similar to, or the same as, in many respects as the cable 610 of FIG. 9. For example, the cable 710 can include a first shielding tape 730 and a second shielding tape 754 that include respective pairs of conductive shielding segments 734, 758. However, the first and second shielding tapes 730, 754 are not joined together. Additionally, the conductive shielding segments 758 of the second shielding tape 754 are shown to be disposed on an opposite side of the second shielding tape 754. In some embodiments, an outer shielding tape with conductive shielding segments (not shown) that is similar to or the same as in many respects as the outer shielding tape 330 shown in FIG. 6 can surround the twisted pairs.

Figure 12:
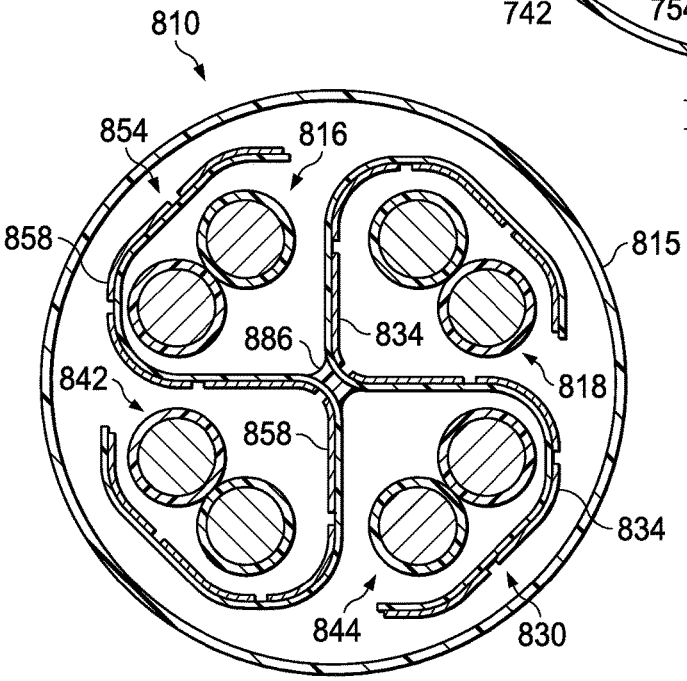
FIG. 12 is a sectional view depicting a cable, in accordance with still yet another embodiment.

Still another alternative embodiment of a cable 810 is illustrated in FIG. 12. The cable 810 can be similar to, or the same as, in many respects as the cable 610 of FIG. 9. For example, the cable 810 can include first, second, third, and fourth twisted pairs 816, 818, 842, 844 of insulated conductors. A first shielding tape 830 and a second shielding tape 854 can include respective pairs of conductive shielding segments 834, 858 and can be joined together at a central location 886. An outer jacket 815 can surround the first and second shielding tapes 830, 854 and the first, second, third, and fourth twisted pairs 816, 818, 842, 844.

However, the first and second shielding tapes 830, 854 can be routed among the first, second, third, and fourth twisted pairs 816, 818, 842, 844 such that they cooperate to form an S-shape. For example, the first shielding tape 830 can extend between the second and fourth twisted pairs 818, 844, between the second twisted pair 818 and the outer jacket 815, and between the fourth twisted pair 844 and the outer jacket 815. The second shielding tape 854 can extend between the first and third twisted pairs 816, 842, between the first twisted pair 816 and the outer jacket 815, and between the third twisted pair 842 and the outer jacket 815.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A cable comprising:
a first twisted pair of insulated conductors;
a second twisted pair of insulated conductors;
a third twisted pair of insulated conductors;
a fourth twisted pair of insulated conductors;
a first shielding tape that extends between the first and second twisted pairs of insulated conductors and between the second and third twisted pairs of insulated conductors, the first shielding tape comprising:
a first substrate; and
a plurality of first conductive shielding segments disposed on the first substrate, each first conductive shielding segment being spaced from each immediately adjacent first conductive shielding segment in a longitudinal direction;
a second shielding tape that extends between the third and fourth twisted pairs of insulated conductors and between the first and fourth twisted pairs of insulated conductors, the second shielding tape comprising:
a second substrate; and
a plurality of second conductive shielding segments disposed on the second substrate, each second conductive shielding segment being spaced from each immediately adjacent second conductive shielding segment in a longitudinal direction; and
an outer jacket surrounding the first, second, third, and fourth twisted pairs of insulated conductors and the first and second shielding tapes; wherein:
the first shielding tape is joined with the second shielding tape at a joint;
the first substrate and the second substrate each comprise a pair of opposing surfaces and, for each of the first substrate and the second substrate, one of the opposing surfaces is devoid of any conductive shielding segments; and
the opposing surfaces that are devoid of any conductive shielding segments face each other.

2. The cable of claim 1 wherein the first shielding tape and the second shielding tape cooperate to form an X-shape.

3. The cable of claim 1 wherein each of the first substrate and the second substrate is formed substantially of biaxially-oriented polyvinylchloride terephthalate.

4. The cable of claim 1 wherein the conductive shielding segments are formed substantially of aluminum.

5. The cable of claim 1 wherein:
the first shielding tape further extends between the second twisted pair of insulated conductors and the outer jacket and between the third twisted pair of insulated conductors and the outer jacket; and
the second shielding tape further extends between the first twisted pair of insulated conductors and the outer jacket and between the fourth twisted pair of insulated conductors and the outer jacket.

6. The cable of claim 5 wherein the first shielding tape and the second shielding tape cooperate to form an S-shape.

7. The cable of claim 5 wherein the first substrate and the second substrate each comprise a pair of opposing surfaces and, for each of the first substrate and the second substrate, one of the opposing surfaces is devoid of any conductive shielding segments.

8. The cable of claim 5 wherein each of the first substrate and the second substrate is formed substantially of biaxially-oriented polyvinylchloride terephthalate.

9. The cable of claim 5 wherein the conductive shielding segments are formed substantially of aluminum.

10. The cable of claim 5 wherein the outer jacket is formed substantially of polyvinyl chloride.

11. The cable of claim 5 wherein each conductive shielding segment is also spaced from each immediately adjacent conductive shielding segment in a radial direction.

12. A cable comprising:
a first twisted pair of insulated conductors;
a second twisted pair of insulated conductors;
a third twisted pair of insulated conductors;
a fourth twisted pair of insulated conductors;
a substantially flat separator extending between the first and fourth twisted pairs of insulated conductors and between the second and third twisted pairs of insulated conductors but not extending between the first and second twisted pairs of insulated conductors nor between the third and fourth twisted pairs of insulated conductors, the substantially flat separator comprising:

a plurality of first conductive shielding segments, each first conductive shielding segment being spaced from each immediately adjacent first conductive shielding segment in a longitudinal direction; and a first substrate overlying the plurality of first conductive shielding segments, wherein the first substrate is formed of a dielectric material; and an outer jacket surrounding the first twisted pair of insulated conductors, the second twisted pair of insulated conductors, and the substantially flat separator.

13. The cable of claim 12 further comprising a second shielding tape surrounding the first twisted pair of insulated conductors, the second twisted pair of insulated conductors, and the substantially flat separator, the second shielding tape underlying the outer jacket, the second shielding tape comprising:

a second substrate; and a plurality of second conductive shielding segments disposed on the second substrate, each second conductive shielding segment being spaced from each immediately adjacent second conductive shielding segment in a longitudinal direction.

14. The cable of claim 12 wherein the first substrate comprises opposing surfaces and one of the opposing surfaces is devoid of any first conductive shielding segments.

15. The cable of claim 12 wherein the first substrate is formed substantially of biaxially-oriented polyvinylchloride terephthalate.

16. The cable of claim 12 further comprising a second substrate underlying the plurality of first conductive shielding segments, wherein the second substrate is formed of a dielectric material.

17. The cable of claim 16 wherein the substantially flat separator further comprises:

an interior substrate formed of a dielectric material, the plurality of first conductive shielding segments being disposed on the interior substrate;

a plurality of second conductive shielding segments disposed on the interior substrate opposite the first conductive shielding segments, such that the interior substrate is sandwiched between the first conductive shielding segments and the second conductive shielding segments; and a second substrate overlying the plurality of second conductive shielding segments, wherein the second substrate is formed of a dielectric material.

* * * * *